US010815756B2

(12) United States Patent
Bishop et al.

(10) Patent No.: US 10,815,756 B2
(45) Date of Patent: Oct. 27, 2020

(54) AXIAL-TO-ROTARY MOVEMENT CONFIGURATION, METHOD AND SYSTEM

(71) Applicants: David Bishop, Cypress, TX (US); Shane Harris, Houston, TX (US)

(72) Inventors: David Bishop, Cypress, TX (US); Shane Harris, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 136 days.

(21) Appl. No.: 15/866,098

(22) Filed: Jan. 9, 2018

(65) Prior Publication Data

US 2019/0211649 A1 Jul. 11, 2019

(51) Int. Cl.
*E21B 41/00* (2006.01)
*E21B 4/00* (2006.01)

(52) U.S. Cl.
CPC ..... *E21B 41/00* (2013.01); *E21B 4/006* (2013.01)

(58) Field of Classification Search
CPC ..... E21B 41/00
See application file for complete search history.

(56) References Cited

U.S. PATENT DOCUMENTS

| | | | | |
|---|---|---|---|---|
| 1,901,513 | A | 3/1933 | Harris | |
| 2,790,623 | A | 4/1957 | Hamp et al. | |
| 2,805,553 | A | 10/1957 | Allard et al. | |
| 2,916,014 | A * | 12/1959 | Bross | B43K 24/084 401/110 |
| 3,075,590 | A | 1/1963 | Cook | |
| 3,355,189 | A | 11/1967 | Hasha | |
| 4,411,315 | A | 10/1983 | Baker et al. | |
| 4,573,536 | A | 3/1986 | Lawrence | |
| 4,697,638 | A | 10/1987 | Knight | |
| 4,771,646 | A | 9/1988 | Ruggier et al. | |
| 5,028,217 | A | 7/1991 | Miller | |
| 5,806,404 | A | 9/1998 | Sher | |
| 6,082,472 | A | 7/2000 | Verstraeten | |
| 7,416,026 | B2 | 8/2008 | Naquin et al. | |
| 9,995,087 | B2 * | 6/2018 | Queen | E21B 10/44 |
| 2010/0276158 | A1 * | 11/2010 | Ingraham | E21B 23/002 166/381 |
| 2013/0204204 | A1 | 8/2013 | Butler et al. | |
| 2016/0273311 | A1 * | 9/2016 | Mageren | E21B 23/004 |

FOREIGN PATENT DOCUMENTS

| | | | | |
|---|---|---|---|---|
| GB | 2368862 A | * | 5/2002 | E21B 41/0042 |
| JP | 2009108993 A | | 5/2009 | |

OTHER PUBLICATIONS

International Search Report and Written Opinion; PCT/US2018/062448; dated Jul. 19, 2019; 9 pages.

* cited by examiner

*Primary Examiner* — Silvana C Runyan
(74) *Attorney, Agent, or Firm* — Cantor Colburn LLP

(57) ABSTRACT

An axial-to-rotary movement configuration including a sleeve having a sleeve angulated castellation and a lug receptacle, a lug disposed in the lug receptacle, and a mandrel disposed in part within the sleeve, the mandrel having a mandrel angulated castellation nestable with the sleeve angulated castellation and further including an extension cam surface and a ramp, the ramp having a limit surface and configured to allow rotational motion of the sleeve relative to the mandrel in one direction only.

11 Claims, 3 Drawing Sheets

AXIAL-TO-ROTARY MOVEMENT CONFIGURATION, METHOD AND SYSTEM

BACKGROUND

In instances, it is desirable to impart a rotary torque to a system through the use of axial movement. This is done using configurations known as J-slots, and other angulated castellation forms in devices such as click pens, downhole mule shoes, etc. These devices are limited to axial movement based upon other related construction or simply due to manufacturers intent but in each case the application of axial movement in one direction the opposing direction or both depending upon the specific construction will produce a rotational movement in another component of the device. These devices work well for their intended purposes but in some torque producing situation, where torque wind up is possible, they may not function entirely as intended. Accordingly the art would be receptive to alternative configurations that can reliably impart torque in the situations where such might be problematic in the prior art devices.

SUMMARY

An axial-to-rotary movement configuration including a sleeve having a sleeve angulated castellation and a lug receptacle, a lug disposed in the lug receptacle, and a mandrel disposed in part within the sleeve, the mandrel having a mandrel angulated castellation nestable with the sleeve angulated castellation and further including an extension cam surface and a ramp, the ramp having a limit surface and configured to allow rotational motion of the sleeve relative to the mandrel in one direction only.

An axial-to-rotary movement configuration including a mandrel, a sleeve interactive with the mandrel, at least two cam surfaces one being a part of each of the mandrel and the sleeve, the cam surfaces configured to induce rotational motion between the mandrel and the sleeve upon axial displacement of one of the sleeve and mandrel from the other of the sleeve and mandrel, and a one-way configuration disposed in communication with the mandrel and the sleeve that allows rotational movement of the sleeve and the mandrel relative to the other of the sleeve and the mandrel while preventing rotational movement in the opposite rotational direction.

A method for rotating a component through axial movement including moving one of a mandrel and a sleeve relative to the other of the mandrel and sleeve in an axial direction, causing a cam surface on one of the mandrel and the sleeve to interact with a component of the other of the mandrel and the sleeve, advancing a one-way configuration such that rotational movement imparted to the one of the mandrel and the sleeve is retained in the one of the mandrel and the sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
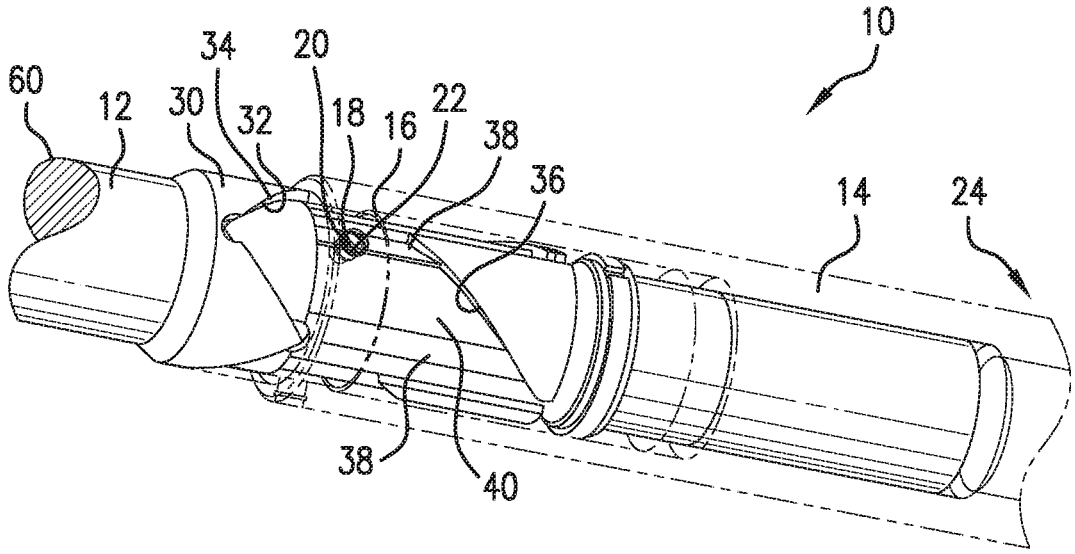
FIG. 1 is a perspective partially transparent view of an axial-to-rotary movement configuration as disclosed herein in an axially compressed position.
Figure 2:
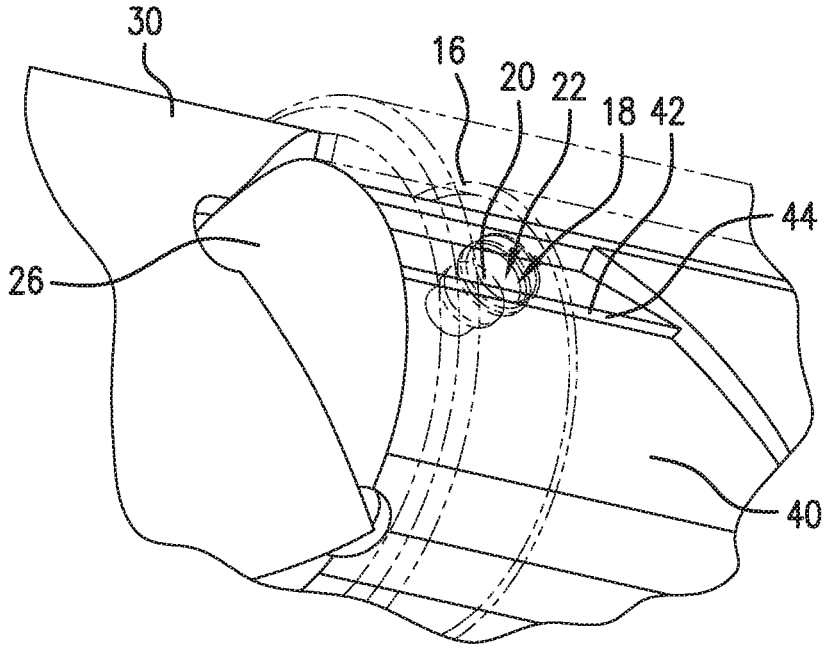
FIG. 2 is an enlarged view of a portion of FIG. 1.

Referring to FIGS. 1 and 2, an axial-to-rotary movement configuration 10 is illustrated in perspective view. A mandrel 12 is shown disposed partially within a sleeve 14, the sleeve 14 being illustrated as transparent. The sleeve 14 includes a shoulder 16, which is load bearing, and a lug receptacle 18. Within the lug receptacle is a lug 20 and a biasing member 22 configured to urge the lug radially inwardly of the sleeve 14. The sleeve also includes a sleeve angulated castellation 26.

It is to be understood that the term lug has been selected only because of the selected type of illustration. The lug (in connection with the ramps discussed herein below) is actually a portion of a one-way configuration. The one way configuration may also be constructed as any type of pawl arrangement that allows movement in one direction and a restriction of movement in the other direction. The pawl may be ratcheting or sliding in nature while still being within the scope of the invention. It will be appreciated that the component parts may be reversed such that the lug would be radially outwardly biased if the mandrel is positioned radially outwardly of the lug. More specifically, if the sleeve were configured to be radially inwardly disposed of the mandrel 12 and the mandrel radially outwardly configured and endowed with the features discussed below, the lug would be biased radially outwardly into the mandrel to have the same effect as the configuration as illustrated in the Figures hereof.

The sleeve 14 may be configured in any number of manners at a downhole end 24 thereof to connect with another tool that requires the rotational movement or the movement may simply be for the sleeve 14.

Referring back to the mandrel 12, several geometric features are illustrated. These include a mandrel angulated castellation 30 that supports angled surfaces 32, which operate as cam surfaces to impart rotation to the sleeve 14 through sleeve angulated castellation 26 when configuration 10 is moved to the compressed position. The compressed position is illustrated in FIGS. 1 and 2. The surfaces 32 interact with sleeve cam surfaces 34 of sleeve angulated castellation 26 during the compressive portion of the axial movement. Another feature of the mandrel 12 is extension cam surfaces 36 that interact with lugs 20 during axial extension of the configuration 10. It will also be appreciated from the Figures that there are ramps 38 disposed axially along the mandrel 12. Ramps 38 are positioned at each end of extension cam surfaces 36. Each ramp 38 is configured to have a substantially smooth transition from a slide surface 40 having a first radial dimension of the mandrel 12 to a ramp termination edge 42, which has a radial dimension of the mandrel 12 that is greater than the slide surface 40. The ramps 38 step back to the next slide surface 40 at the ramp termination edge 42. This configuration encourages movement of the lugs 20 over the ramps 38 in one direction (the desired direction) and prevents their movement over the ramps 38 in the other direction due to contact with a limit surface 44. This is important in that this is what allows the configuration 10 to impart torque in situations where torque wind up would be likely without the potential for the configuration 10 rotating backwards when the axial actuating force is removed. The prior art, as noted above, is susceptible to rotating backwards when the axial actuating force is removed.

Referring to operation of the configuration 10 and hence all of the Figures, the configuration 10 is illustrated in the collapsed position in FIGS. 1 and 2 and it will be apparent that cam surfaces 32 are in contact with sleeve cam surfaces 34. Further it will be appreciated that the surfaces 32 and 34 are fully nested in FIGS. 1 and 2. This is why the configuration 10 is considered to be fully collapsed. The surfaces 32 and 34 are load bearing and when nested the configuration will no longer move in the collapse direction. The lug 20 is seen to be in contact with one of the slide surfaces 40 and in tangential contact with one of the limit surfaces 44. It will be understood that even if the sleeve 14 is torque loaded and is storing torque (torque wind up) the sleeve 14 will not be able to rotated back in the direction from whence it came because to do so would require the lugs 20 climbing the limit surfaces 44, which they cannot do.

Figure 3:
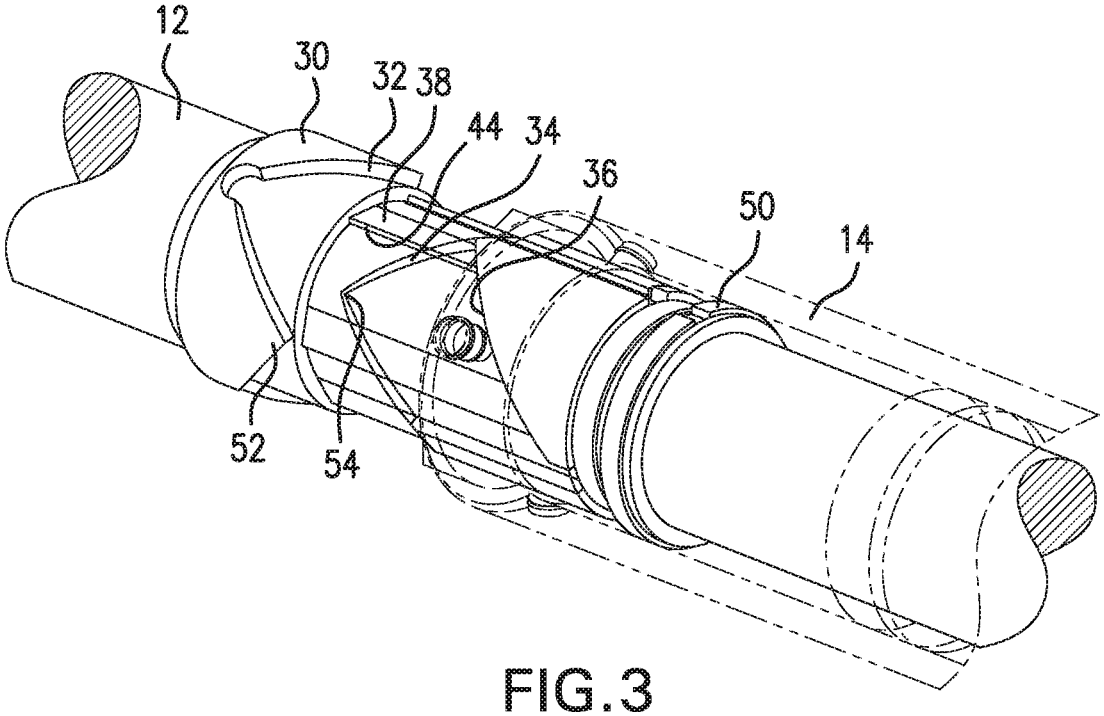
FIG. 3 is the configuration of FIG. 1 in a partially extended position.
Figure 4:
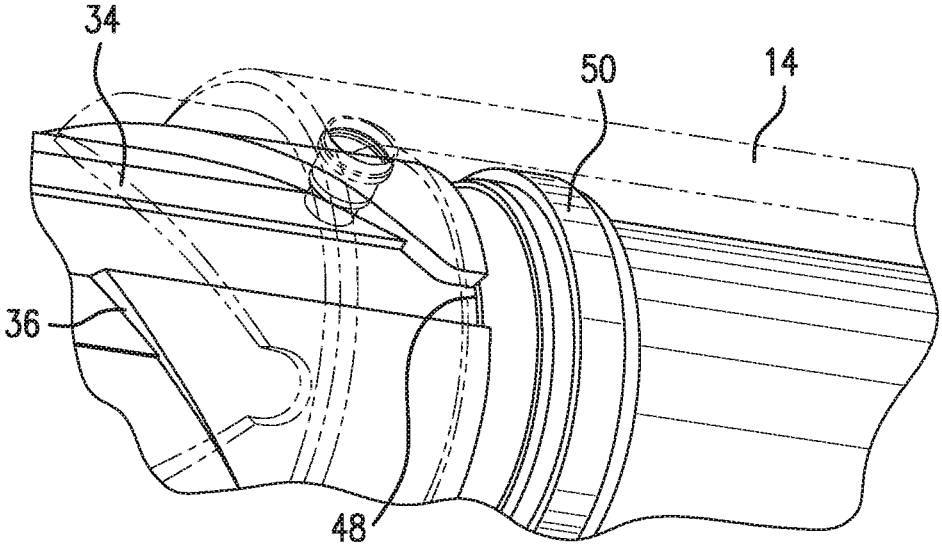
FIG. 4 is an enlarged view of a portion of the configuration illustrating a ramp surface and limit surface.
Figure 5:
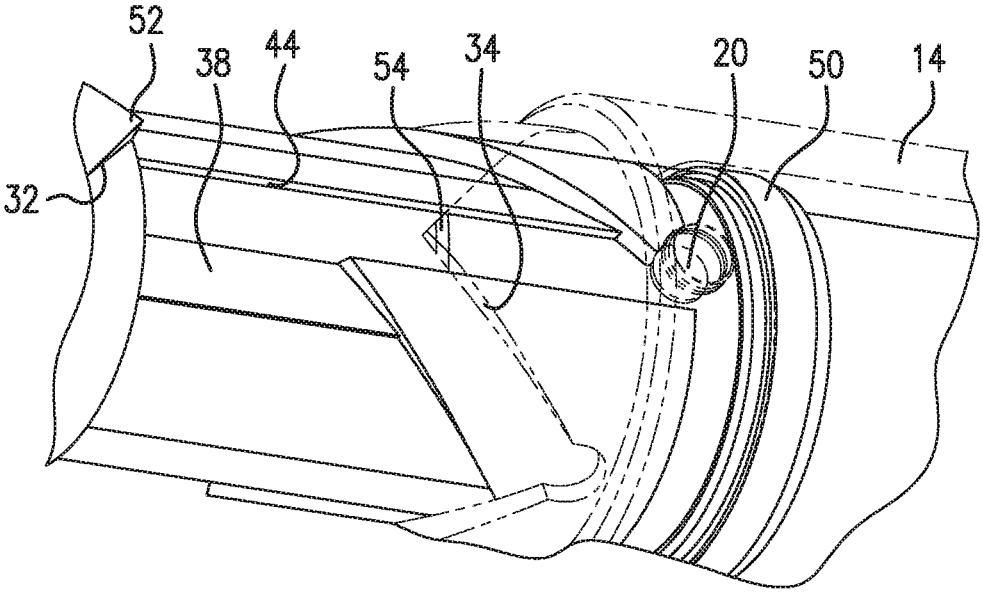
FIG. 5 is an enlarged view of a portion of the configuration in a fully extended position.

Moving to FIG. 3, the mandrel 12 has been pulled from the collapsed position to an intermediate position wherein the lugs 20 have landed on extension cam surface 36. It will also be appreciated that the lug has already moved rotationally away from the limit surface 44 upon which it was resting in FIGS. 1 and 2. This is due to the extension cam surface 36 angle and the pulling force being applied through the mandrel 12. Rotational motion will continue until the pull force on the mandrel 12 is halted. Referring to FIG. 4, the lug 20 is climbing ramp 38 on its way to dropping (radially inwardly extending pursuant to the biasing member urging the lug radially inwardly) to the next slide surface 40 adjacent the next limit surface 44. Referring to FIG. 5, it is illustrated that the lug will continue to move along the extension cam surface 36 until migrating to a pocket 48 (marked in FIG. 4 and occupied by the lug 20 in FIG. 5). The pocket allows space so that the lugs 20 do not bear the full weight of a string hanging therefrom but rather allow the weight to be borne by a snap ring 50 on the mandrel 12 that interacts with shoulder 16 of sleeve 14.

It will also be appreciated in FIG. 5 that the cam surfaces 32 and 34 have rotated to a point where a compression stroke of the configuration 10 will cause further rotation of the sleeve in the same desired direction as peaks 52 and 54 of the surfaces 32 and 34 respectively have passed one another rotationally due to the rotational movement caused by the extension stroke and the lugs 20 interacting with the extension cam surfaces 36. Completing the compression stroke will bring the configuration back to the position of FIG. 1. The process may then be repeated indefinitely resulting in one way only rotation of the sleeve 14 and anything attached thereto. In embodiments, there are 6 peaks 52/54 and accordingly a 60 degree rotation is accomplished for each complete movement from full collapse through full extension and back to full collapse. Other numbers of peaks and accordingly different number of degrees of rotation is also contemplated in embodiments.

It is noted that the configuration has particular utility in the resource recovery industry but may also find use in other industries requiring a one way only rotation based upon axial movement.

It is to be appreciated that the mandrel 12 may form a portion of downhole system including a string 60 such as a work string, drill string, completion string, production string, etc. extending from a distant location such as a surface location through a resource exploration or recovery borehole.

Set forth below are some embodiments of the foregoing disclosure:

Embodiment 1: An axial-to-rotary movement configuration including a sleeve having a sleeve angulated castellation and a lug receptacle, a lug disposed in the lug receptacle, and a mandrel disposed in part within the sleeve, the mandrel having a mandrel angulated castellation nestable with the sleeve angulated castellation and further including an extension cam surface and a ramp, the ramp having a limit surface and configured to allow rotational motion of the sleeve relative to the mandrel in one direction only.

Embodiment 2: The configuration as in any prior embodiment wherein the mandrel further includes a slide surface interactive with the lug.

Embodiment 3: The configuration as in any prior embodiment wherein the ramp includes a substantially smooth transition with the slide surface.

Embodiment 4: The configuration as in any prior embodiment wherein the ramp when considered circumferentially of the mandrel has a radial dimension on one edge that is substantially the same as a radial dimension of the slide surface and another edge that has a radial dimension larger than the slide surface.

Embodiment 5: The configuration as in any prior embodiment wherein the radial dimension larger than the slide surface creates a limit surface.

Embodiment 6: The configuration as in any prior embodiment wherein the limit surface interacts with the lug to prevent movement in a direction opposite a desired direction of rotational movement of the sleeve.

Embodiment 7: An axial-to-rotary movement configuration including a mandrel, a sleeve interactive with the mandrel, at least two cam surfaces one being a part of each of the mandrel and the sleeve, the cam surfaces configured to induce rotational motion between the mandrel and the sleeve upon axial displacement of one of the sleeve and mandrel from the other of the sleeve and mandrel, and a one-way configuration disposed in communication with the mandrel and the sleeve that allows rotational movement of the sleeve and the mandrel relative to the other of the sleeve and the mandrel while preventing rotational movement in the opposite rotational direction.

Embodiment 8: The configuration as in any prior embodiment wherein the one-way configuration is a lug and a ramp.

Embodiment 9: A method for rotating a component through axial movement including moving one of a mandrel and a sleeve relative to the other of the mandrel and sleeve in an axial direction, causing a cam surface on one of the mandrel and the sleeve to interact with a component of the other of the mandrel and the sleeve, advancing a one-way configuration such that rotational movement imparted to the one of the mandrel and the sleeve is retained in the one of the mandrel and the sleeve.

Embodiment 10: The method as in any prior embodiment wherein the mandrel includes a ramp and a slide surface, the ramp having one edge with a radial dimension substantially the same as the slide surface and the ramp having a second edge with a radial dimension larger than a radial dimension of the slide surface and wherein the advancing is moving a lug over the ramp to drop to the slide surface over the edge of the ramp having a larger radial dimension.

Embodiment 11: The method as in any prior embodiment wherein the advancing is compressing a length of the configuration.

Embodiment 12: The method as in any prior embodiment wherein the advancing is extending a length of the configuration.

Embodiment 13: The method as in any prior embodiment wherein the advancing further includes extending a length of the configuration.

Embodiment 14: A system including a configuration as in any prior embodiment attached to a string extending through a borehole from a remote location.

Embodiment 15: The system as in any prior embodiment wherein the remote location is a surface location.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An axial-to-rotary movement configuration comprising:

a sleeve having a sleeve angulated castellation and a lug receptacle;

a lug disposed in the lug receptacle; and a mandrel disposed in part radially within the sleeve, the mandrel having a mandrel angulated castellation nestable with the sleeve angulated castellation and further including an extension cam surface and a ramp having a first radial dimension from a longitudinal axis of the mandrel at a beginning of the ramp and a second radial dimension from the longitudinal axis of the mandrel at an end of the ramp, the second radial dimension being larger than the first radial dimension, the ramp configured and positioned to displace the lug radially outwardly with relative rotation between the sleeve and the mandrel, the ramp having a radially oriented limit surface extending from the second radial dimension of the ramp toward the first radial dimension of the ramp, the axial-to-rotary movement configuration configured to allow rotational motion of the sleeve relative to the mandrel in one direction only due to the lug riding on the cam surface, ramp and limit surface during use.

2. The configuration as claimed in claim 1 wherein the mandrel further includes a slide surface interactive with the lug.

3. The configuration as claimed in claim 2 wherein the ramp includes a substantially smooth transition with the slide surface.

4. An axial-to-rotary movement configuration comprising:

a mandrel;

a sleeve radially outwardly disposed of and interactive with the mandrel;

at least two cam surfaces one being a part of each of the mandrel and the sleeve, the cam surfaces configured to induce rotational motion between the mandrel and the sleeve upon axial displacement of one of the sleeve and mandrel from the other of the sleeve and mandrel; and a one-way configuration disposed in communication with the mandrel and the sleeve that allows rotational movement of the sleeve and the mandrel relative to the other of the sleeve and the mandrel while preventing rotational movement in the opposite rotational direction such that torque is stored in the axial-to-rotary movement configuration regardless of in which direction the axial displacement between the sleeve and mandrel occurs, the one-way configuration comprising a ramp having a first radial dimension from a longitudinal axis of the mandrel at a beginning of the ramp and a second radial dimension from the longitudinal axis of the mandrel at an end of the ramp, the second radial dimension being larger than the first radial dimension, the ramp configured and positioned to displace a lug disposed in the sleeve radially outwardly with relative rotation between the sleeve and the mandrel, the ramp having a radially oriented limit surface extending from the second radial dimension of the ramp toward the first radial dimension of the ramp.

5. A method for rotating a component through axial movement comprising:

moving one of a mandrel and a sleeve disposed at least in part radially outwardly of the mandrel relative to the other of the mandrel and sleeve in an axial direction;

causing a cam surface on one of the mandrel and the sleeve to interact with a component of the other of the mandrel and the sleeve;

advancing a one-way configuration including, a radially displaceable lug and a ramp having a first radial dimension from a longitudinal axis of the mandrel at a beginning of the ramp and a second radial dimension from the longitudinal axis of the mandrel at an end of the ramp, the second radial dimension being larger than the first radial dimension such that rotational movement imparted and torque imparted to the one of the mandrel and the sleeve is retained in the one of the mandrel and the sleeve.

6. The method as claimed in claim 5 wherein the mandrel includes a slide surface at a radial dimension substantially the same as the first radial dimension.

7. The method as claimed in claim 5 wherein the advancing is compressing a length of the one-way configuration.

8. The method as claimed in claim 5 wherein the advancing is extending a length of the one-way configuration.

9. The method as claimed in claim 7 wherein the advancing further includes extending a length of the one-way configuration.

10. A system comprising:

an axial-to-rotary movement configuration as claimed in claim 1 attached to a string extending through a borehole from a remote location.

11. The system as claimed in claim 10 wherein the remote location is a surface location.

* * * * *